US009972163B2

(12) United States Patent
Hornik

(10) Patent No.: US 9,972,163 B2
(45) Date of Patent: May 15, 2018

(54) ASSOCIATION OR LINKING OF SYMBOL BEARING ARRAY ELEMENTS IN A GAMING MACHINE

(71) Applicant: WMS Gaming Inc., Waukegan, IL (US)

(72) Inventor: Jeremy Hornik, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 527 days.

(21) Appl. No.: 14/607,660

(22) Filed: Jan. 28, 2015

(65) Prior Publication Data

US 2016/0217646 A1 Jul. 28, 2016

(51) Int. Cl.
*G07F 17/32* (2006.01)
*G07F 17/34* (2006.01)

(52) U.S. Cl.
CPC ..... *G07F 17/3213* (2013.01); *G07F 17/3244* (2013.01); *G07F 17/3265* (2013.01); *G07F 17/34* (2013.01); *G07F 17/3209* (2013.01); *G07F 17/3216* (2013.01)

(58) Field of Classification Search
CPC .. G07F 17/34; G07F 17/3213; G07F 17/2344; G07F 17/2365; G07F 17/3244; G07F 17/3265
See application file for complete search history.

(56) References Cited

U.S. PATENT DOCUMENTS 4,184,683 A 1/1980 Hooker ..... 273/143 R
4,198,052 A 4/1980 Gauselmann ..... 273/143 R
5,580,053 A 12/1996 Crouch ..... 463/20
5,611,535 A 3/1997 Tiberio ..... 273/143 R
5,976,016 A 11/1999 Moody et al. ..... 463/13
6,241,607 B1 * 6/2001 Payne ..... G07F 17/34 273/143 R
6,261,178 B1 7/2001 Bennett ..... 463/20
6,413,162 B1 * 7/2002 Baerlocher ..... G07F 17/3202 273/143 R
6,544,120 B2 4/2003 Ainsworth ..... 463/20
6,604,999 B2 8/2003 Ainsworth ..... 463/20
6,676,511 B2 1/2004 Payne et al. ..... 463/20
(Continued)

*Primary Examiner* — William H McCulloch, Jr.
(74) *Attorney, Agent, or Firm* — Marc D. Thompson; Grant A. Dingledine

(57) ABSTRACT

A gaming system includes a wagering game mechanism associating the game-outcome symbol of multiple reels of the wagering game to a unified game-symbol outcome. The wagering game generates an outcome symbol array with independent array elements and one or more associated groups of array elements. The associated groups of array elements are visually coordinated while the reels are spinning. Each associated group of array elements share a common game-outcome symbol based upon reels having a common reel strip for the associated group or a particular game-outcome symbol array element of the associated group. When the reels stop spinning and the wagering game outcome is displayed, the elements of a given associated group share an identical game-outcome symbol. Each array element not a part of a associated group uses a reel having a default reel strip to determine game-outcome symbols, and associated group array elements use a reel having a reel strip containing at least one symbol common to every element of the associated group.

20 Claims, 7 Drawing Sheets

(56) References Cited

U.S. PATENT DOCUMENTS

| | | | | |
|---|---|---|---|---|
| 7,001,274 | B2 | 2/2006 | Baerlocher et al. | 463/20 |
| 7,309,281 | B2 | 12/2007 | Baerlocher et al. | 463/20 |
| 7,309,282 | B2 | 12/2007 | Baerlocher et al. | 463/20 |
| 7,347,777 | B2 | 3/2008 | Gauselmann | 463/25 |
| 7,387,570 | B2 | 6/2008 | Randall | 463/20 |
| 7,393,277 | B2 | 7/2008 | Jackson | 463/20 |
| 7,431,645 | B2 | 10/2008 | Han et al. | 463/16 |
| 7,494,413 | B2 | 2/2009 | Singer et al. | 463/20 |
| 7,780,519 | B2 | 8/2010 | Gomez et al. | 463/25 |
| 8,197,329 | B2 | 6/2012 | Englman et al. | 463/20 |
| 8,641,508 | B2 | 2/2014 | Yoshimi | 463/20 |
| 8,747,207 | B2 | 6/2014 | Thomas et al. | 463/16 |
| 9,424,720 | B2 * | 8/2016 | Suda | G07F 17/34 |
| 9,478,107 | B2 * | 10/2016 | Nakamura | G07F 17/3265 |
| 9,640,024 | B2 * | 5/2017 | Hornik | G07F 17/3213 |
| 9,666,020 | B2 * | 5/2017 | Gobe | G07F 17/3213 |
| 9,773,369 | B2 * | 9/2017 | Berman | G07F 17/34 |
| 2002/0155882 | A1 | 10/2002 | Baerlocher et al. | 463/20 |
| 2004/0033827 | A1 | 2/2004 | Gilmore et al. | 463/20 |
| 2005/0119047 | A1 * | 6/2005 | Olive | G07F 17/32 463/27 |
| 2005/0239539 | A1 * | 10/2005 | Inamura | G07F 17/3265 463/20 |
| 2006/0058097 | A1 | 3/2006 | Berman et al. | 463/20 |
| 2006/0066051 | A1 | 3/2006 | Nicely | 273/292 |
| 2006/0111174 | A1 | 5/2006 | Baerlocher et al. | 463/20 |
| 2006/0154717 | A1 | 7/2006 | Jackson | 463/20 |
| 2006/0160613 | A1 | 7/2006 | Hornik et al. | 463/25 |
| 2007/0060255 | A1 * | 3/2007 | Baerlocher | G07F 17/3213 463/16 |
| 2009/0298573 | A1 * | 12/2009 | Bramble | G07F 17/32 463/20 |
| 2010/0120506 | A1 * | 5/2010 | Davis | G07F 17/3267 463/20 |
| 2011/0201406 | A1 * | 8/2011 | Jaffe | G07F 17/32 463/21 |
| 2012/0172106 | A1 * | 7/2012 | Caputo | G07F 17/34 463/20 |
| 2014/0087822 | A1 * | 3/2014 | Watkins | G07F 17/326 463/20 |
| 2014/0179402 | A1 * | 6/2014 | Delekta | G07F 17/3262 463/20 |
| 2014/0274292 | A1 * | 9/2014 | Suda | G07F 17/34 463/20 |
| 2014/0309010 | A1 * | 10/2014 | Pawloski | G07F 17/34 463/20 |
| 2014/0309011 | A1 * | 10/2014 | Pawloski | G07F 17/34 463/20 |
| 2015/0105137 | A1 * | 4/2015 | Delekta | G07F 17/3213 463/20 |
| 2015/0287269 | A1 * | 10/2015 | Berman | G07F 17/34 463/20 |
| 2016/0217646 | A1 * | 7/2016 | Hornik | G07F 17/3213 |
| 2016/0217647 | A1 * | 7/2016 | Hornik | G07F 17/3213 |
| 2016/0379439 | A1 * | 12/2016 | Galasso | G07F 17/3227 463/21 |

* cited by examiner

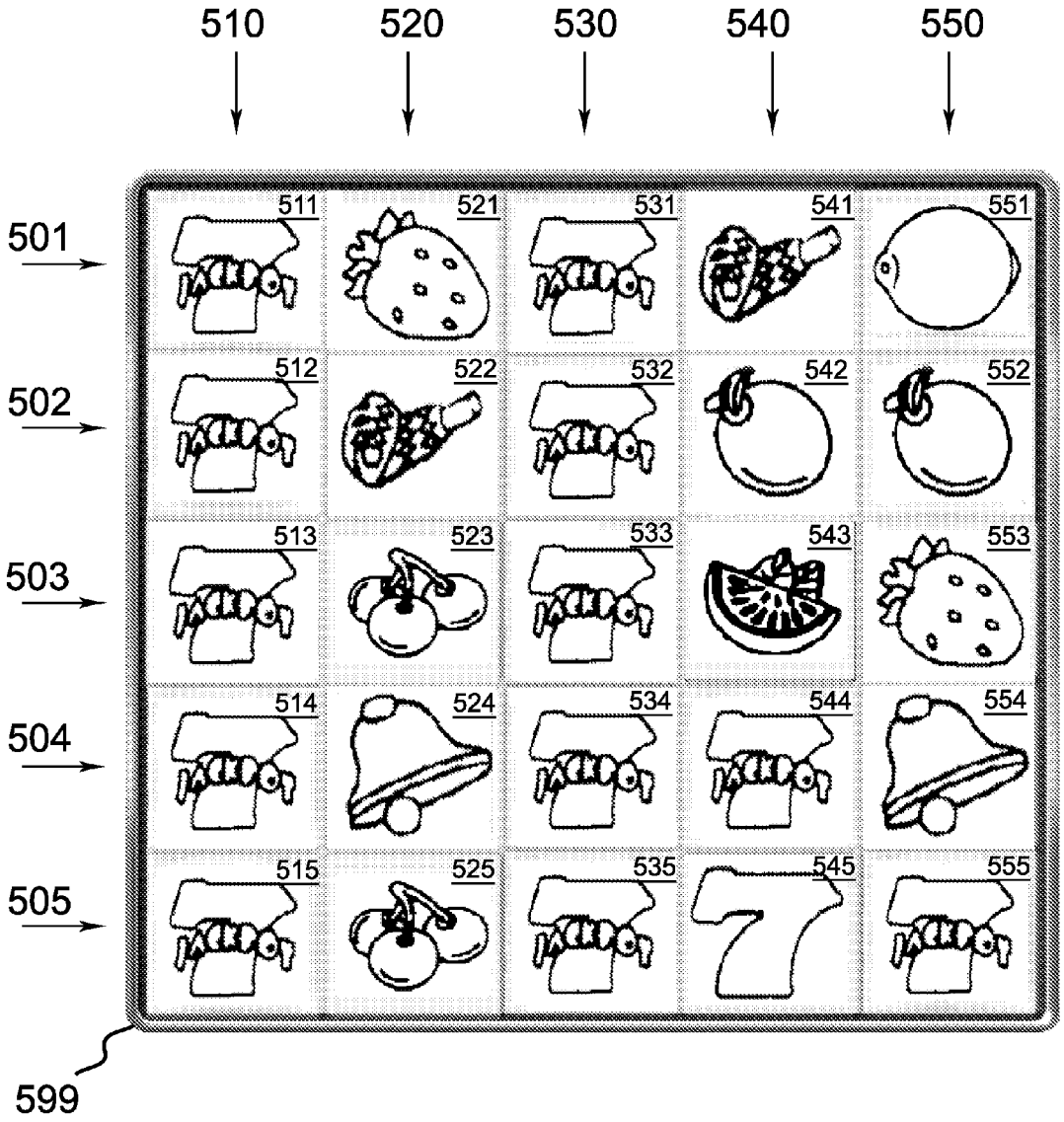
FIG. 5
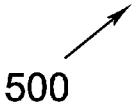

ASSOCIATION OR LINKING OF SYMBOL BEARING ARRAY ELEMENTS IN A GAMING MACHINE

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a game mechanic for a video slot wagering machine which associates the game-symbol outcome of one or more secondary reels with the outcome of a primary reel.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. As the industry matures, the creativity and ingenuity required to improve such operation of gaming apparatus and games grows accordingly.

SUMMARY OF THE INVENTION

According to one aspect of the present invention, a casino gaming machine primarily dedicated to playing at least one regulated casino wagering game is disclosed. The casino wagering game includes a primary wagering game having a symbol array of individual array elements, each having a respective reel defined by a corresponding default reel strip. The gaming machine comprises a secure gaming cabinet for housing components associated with the at least one casino wagering game, an electronic display device coupled to the gaming cabinet, an electronic input device configured to receive a physical input from a player to initiate at least one casino wagering game and transform the input into an electronic data signal, and game-logic circuitry disposed within the gaming cabinet including a random element generator. The random element generator is configured to generate one or more random elements for the wagering game. The game-logic circuitry is further configured to initiate a primary wagering game in response to the electronic data signal from the electronic input device. A plurality, but not all, of the individual array elements are linked together based, at least in part, on the one or more random elements. The corresponding default reel strips of the linked array elements are replaced with a common reel strip selected from a plurality of reel strips. The electronic display device is directed to display the reels of the plurality of array elements of the symbol array actively spinning in accordance with one or more spin profiles. The electronic display device is directed to stop the active spinning of the reels of the array elements at a specific reel stop position of the corresponding reel strip for each array element, resulting in each of the plurality of array elements displaying a game-outcome symbol based, at least in part, on the one or more random elements. The game-outcome symbols displayed by each of the reels of the linked array elements are the same symbol. The electronic display device is directed to display an outcome of the primary wagering game based on the game-outcome symbols of the plurality of array elements of the symbol array, and grant an award in response to the outcome meeting a predetermined award criterion.

According to another aspect of the invention, a computer-implemented method in a gaming system primarily dedicated to playing at least one regulated casino wagering game is disclosed. The casino wagering game includes a primary wagering game having a symbol array of individual array elements. Each individual array element has a respective reel defined by a corresponding default reel strip. The gaming system includes a secure gaming cabinet, a random element generator, game-logic circuitry, an electronic display device, and an electronic input device. The electronic display device and the electronic input device are coupled to the gaming cabinet. The computer-implemented method comprises generating one or more random elements with the random element generator. Responsive to a physical input to the electronic input device, a wager input to initiate the primary wagering game is received. A plurality, but not all, of the individual array elements are linked together by the game-logic circuitry, based, at least in part, on the one or more random elements. The game-logic circuitry replaces the corresponding default reel strip of the linked array elements with a common reel strip selected from a plurality of reel strips. The electronic display device displays the reels of the plurality of array elements of the symbol array actively spinning in accordance with one or more spin profiles. The electronic display device then displays the reels of the plurality of array elements of the symbol array, not spinning and stopped at a specific reel stop position of the corresponding reel strip for the array element. Each of the reels of the plurality of array elements displays a game-outcome symbol based, at least in part, on the one or more random elements, and the game-outcome symbols displayed by each of the linked array elements are the same symbol. The outcome of primary wagering game is displayed on the electronic display device based on the game-outcome symbols of the plurality of array elements of the symbol array, and the game-logic circuitry grants a tangible award in response to the outcome meeting a predetermined award criterion.

According to one aspect of the present invention, a gaming system primarily dedicated to playing at least one regulated casino wagering game is disclosed. The gaming system may be incorporated into a single, freestanding gaming machine. The casino wagering game includes a primary wagering game having a symbol array of individual array elements. Each individual array element having a respective reel defined by a corresponding default reel strip. The gaming system comprises a secure gaming cabinet for housing components associated with the at least one regulated casino wagering game, an electronic display device coupled to the gaming cabinet, an electronic input device configured to receive a physical input from a player to initiate the casino wagering game and transform the input into an electronic data signal, a random element generator configured to generate one or more random elements, and game-logic circuitry. The game-logic circuitry is configured to initiate the primary wagering game in response to the electronic data signal from the electronic input device. A plurality, but not all, of the individual array elements are linked together based, at least in part, on the one or more random elements. The corresponding default reel strips of the linked array elements are replaced with a common reel strip selected from a plurality of reel strips. The electronic display device is directed to display the reels of the plurality of array elements of the symbol array actively spinning in accordance with one or more spin profiles. The electronic display device is directed to display the reels of the plurality of array elements of the symbol array, not spinning and stopped at a specific reel stop position of the corresponding reel strip for each array element. Each of the reels of the plurality of array elements displays a game-outcome symbol based, at least in part, on the one or more random elements, and the game-outcome symbols displayed by each of the reels of the linked array elements are the same symbol. The electronic display device is directed to display an outcome of the primary wagering game based on the game-outcome symbols of the plurality of array elements of the symbol array, and a tangible award is granted in response to the outcome meeting a predetermined award criterion.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 5 is an image of an exemplary basic-game screen of a wagering game displayed on a gaming machine having a linked group comprising a plurality of symbol array elements which conform to the same game-outcome symbol, according to an embodiment of the present invention.

Figure 1:
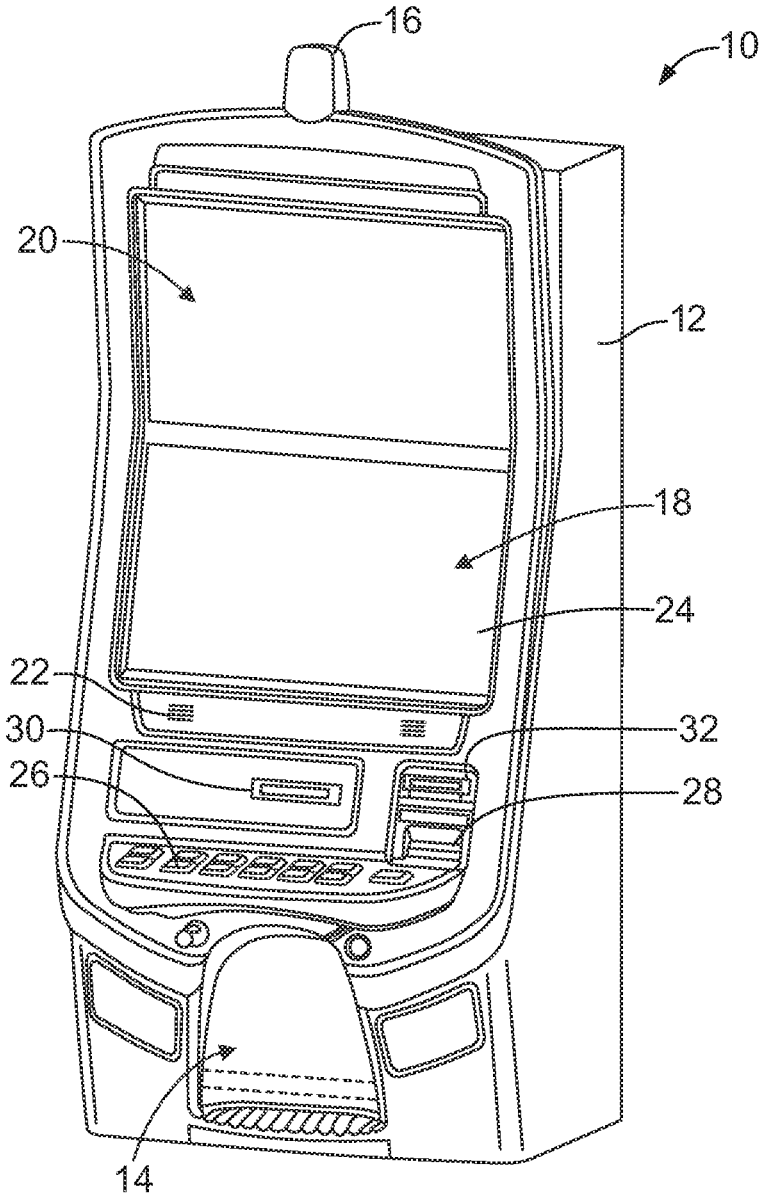
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. No. 6,517,433, U.S. Pat. No. 8,057,303, and U.S. Pat. No. 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
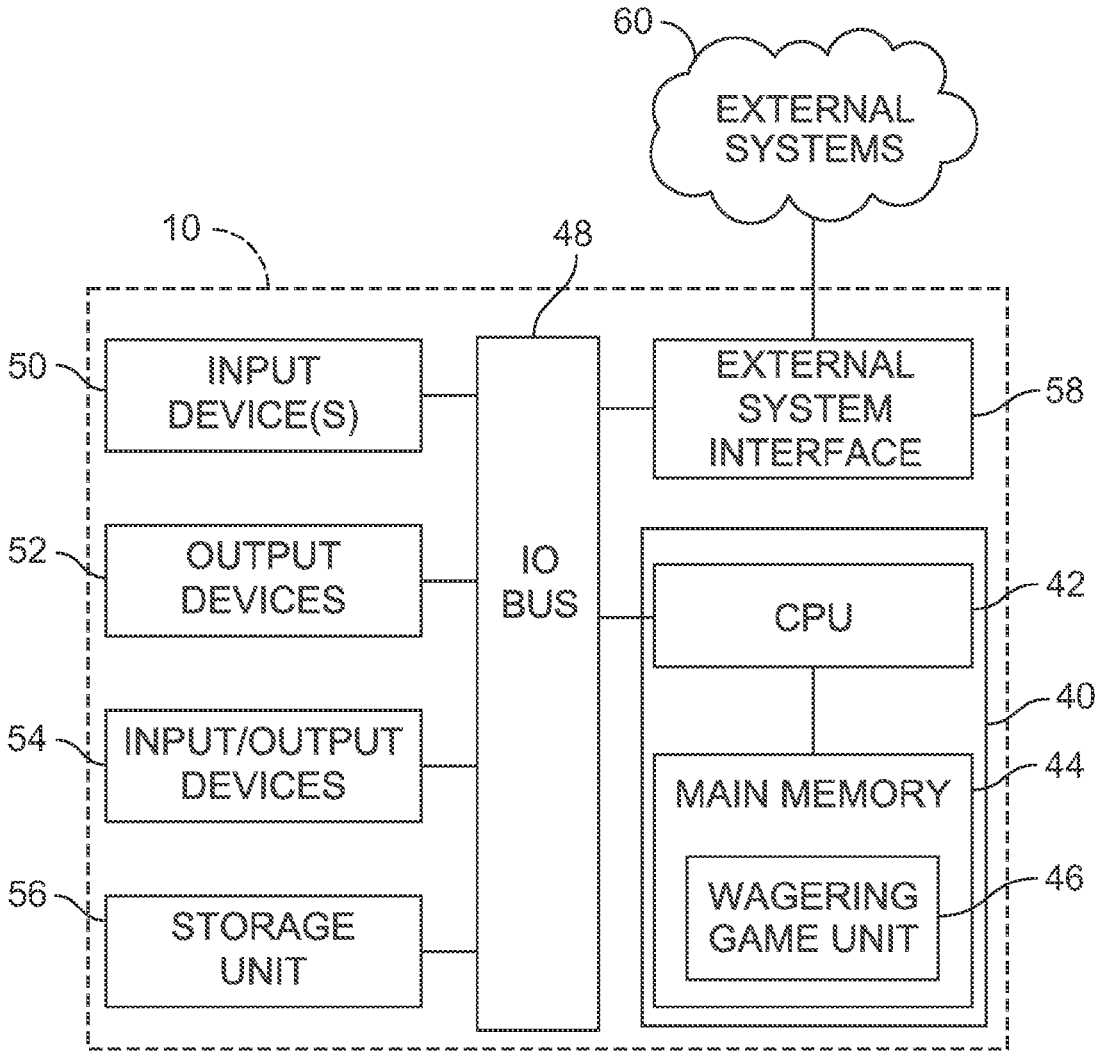
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compares it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
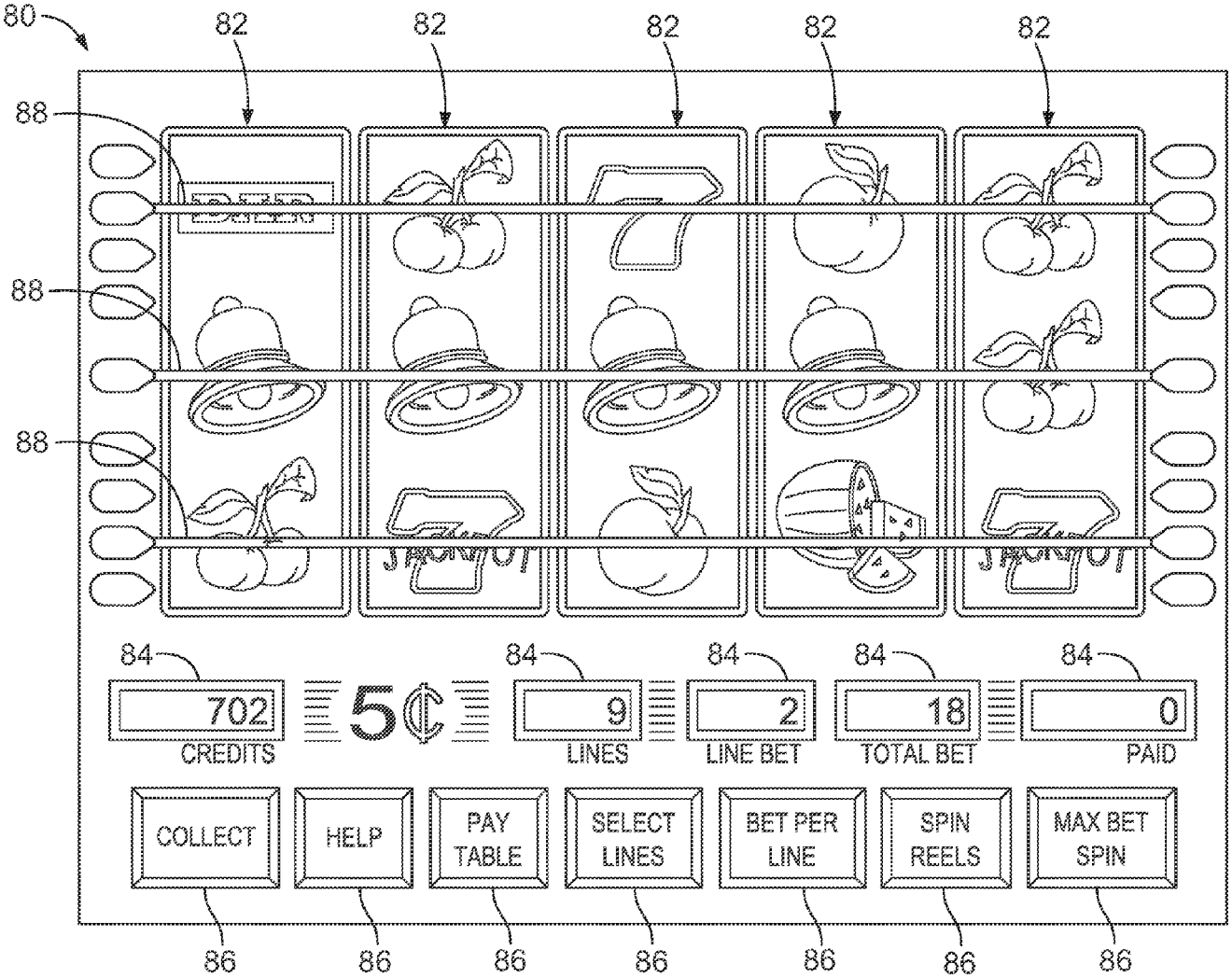
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

In one embodiment, the present invention provides a wagering game mechanism which enables one or more symbol-bearing reels of a graphical symbol array game-outcome to be part of a linked group of array elements. The array elements of the linked group have game-outcomes that are linked together. The array elements of the linked group display the same game-outcome symbol that may be collectively determined for the linked group as a whole (for example, using a common reel strip and associated reel stops). In one embodiment, a wagering game outcome includes the individual outcomes of one or more specific reels linked to the same outcome. For example, in a wagering game having a symbol array of independent reels, all the members of a defined linked group of array elements conform to the same game-output symbol, randomly determined by a single independent reel of the wagering game. In one embodiment, a symbol outcome determined for one of the reels of the wagering game is used to determine the symbol outcome for a set of dependent, linked reels comprising the linked group. Alternatively, a reel may be used to simultaneously determine the symbol outcome for all the linked group elements which is independent from the individual default reels for each of the linked group array elements. Multiple elements of the symbol array may be specified as part of the same linked group, and multiple linked groups may be simultaneously defined and used in the same symbol array. That is, multiple groups of linked array elements may be specified, such that each linked group has multiple linked array elements sharing a common reel strip and game-outcome symbol result.

In one embodiment, the common reel strip defining the symbols and associated probability of selection of the game-outcome symbols for the array elements of a given linked group may be selectively chosen, or even dynamically generated, and may be completely different from a default reel strip used by an array element when not part of a linked group. This allows symbol outcomes for all array elements of a linked group to be restricted to a specific set of symbols having a particular probability for selection. The reel strip used for the array elements of a linked group may be a specified "bonus" reel strip, or alternatively, selected from the set of the default reel strips of the array elements that make up the linked group.

The common reel strip used to determine the game-symbol outcome for a linked group may also include symbols that are not present on any of the default reels of the array elements. The use of a specialized reel for determining a symbol outcome for each array element comprising a linked group may occur in the event of a special bonus round, initiation of a bonus game or free spin, or as a randomly determined result to include a mystery symbol, adjusting symbol, or other variable or random symbol outcome. Further, the use of a specific common bonus reel strip for a linked group may be specified solely based on one or more random elements. A common bonus reel strip may consist of any particular set of potential game-outcome symbols, each game-outcome symbol having a specific probabilistic weighting for selection. A common bonus reel strip may additionally or alternatively include unique symbols present only on the common bonus reel strip.

Figure 4:
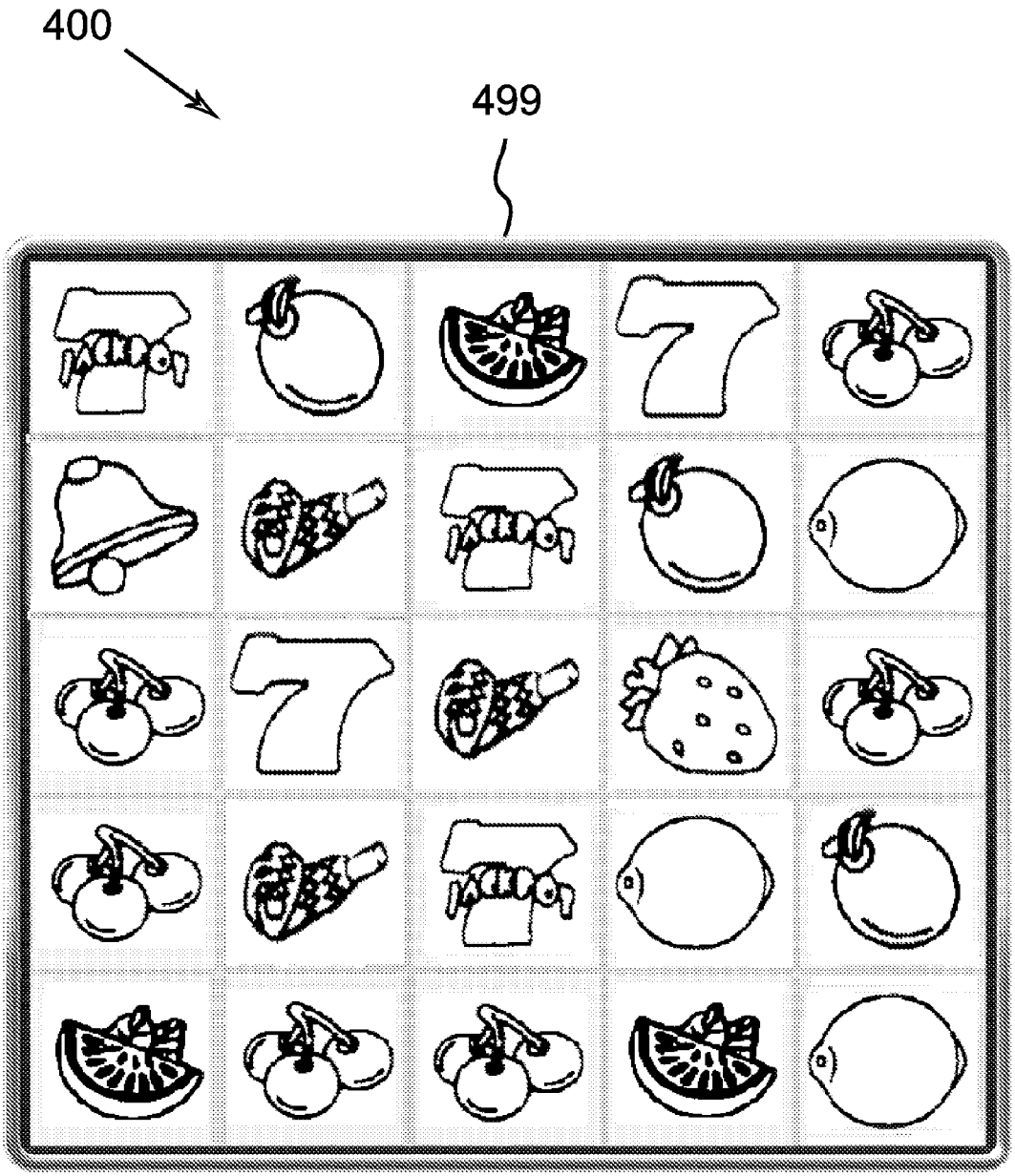
FIG. 4 is an image of an exemplary basic-game screen of a wagering game displayed on a gaming machine showing a game-outcome symbol array comprising a set of stand-alone array elements, according to an embodiment of the present invention.

Referring now to FIG. 4, an image of an exemplary portion of a basic-game screen 400 displayed by a wagering game on a gaming machine is shown. In the present embodiment, the game screen 400 contains a five-by-five symbol array 499. Each array element of the symbol array 499 displays an independently generated game-outcome symbol. In this embodiment, the game logic assigns a particular default reel strip for each array element to randomly determine the symbol outcome for the symbol array 499. For example, FIG. 4 shows a symbol array 499 having twenty-five independent stand-alone array elements generating an outcome for a wagering game. Each array element utilizes an independent reel (having an associated reel strip) for randomly determining a corresponding game-outcome symbol. That is, each of the array elements has a corresponding reel strip defining the potential game-outcome symbols for the particular array element. Typically, a game outcome symbol for an array element is randomly determined using the corresponding reel strip dictated for that specific array element.

In another embodiment, multiple array elements may use an identical, common reel strip to determine a corresponding game outcome symbol. That is, it is possible that distinct array elements of the symbol array 499 use a common (identical) reel strip to determine the symbol outcome for the array element. Reel strips that are commonly utilized by more than one symbol array element may also be assigned as a default reel strip for one or more of the array elements, and be randomly determined for use with some other array elements. It is also possible that two array elements using the same reel strip result in different game-outcome symbols; as the array elements stop spinning and display the game-outcome symbols of the symbol array for the wagering game, array elements utilizing a common reel strip may have different game-outcome symbols.

When a wagering game is initiated, one or more random elements (e.g., numbers) are determined and are used to determine or derive game-outcome symbols for each array element of the symbol array 499. During presentation of the wagering game, the array elements of the symbol array 499 may appear to spin prior to the display of the game-outcome symbol for each array element. Other types of visual presentation may accompany the virtual spinning of the reel having a corresponding reel strip defining the potential game-outcome symbols for each array element. As the reel for each array element of the symbol array 499 stops spinning, a particular game-outcome symbol from an assigned, corresponding reel strip is displayed at each array element location.

In one embodiment, the symbol array 499 is populated with a plurality of array elements. The symbol array 499 has a defined set of reel strips assigned to a particular one or more of the array elements. The reel strips are used to randomly determine the potential game-outcome symbols for each of the corresponding array elements of the symbol array 499. The reel strips have reel-stop values assigned to the symbols on the reel strip used to map one or more of the random elements (e.g., numbers) to a specific symbol (stop position) on the reel strip. Thus, the reel-stop value is used to specify which symbol on the reel strip will be visible for the array element when the reel stops spinning (thereby defining the game-outcome symbol for the reel). When the game-outcome symbols are presented on a display device, each array element of the symbol array 499 will display a graphical game-outcome symbol selected from the set of available symbols on the corresponding reel strip assigned to that particular array element. In one embodiment, each game-outcome symbol is selected for each array element from a corresponding, and unique, assigned reel strip specific to that array element. In other embodiments, the same reel strip may be used by more than one array element to determine the game-outcome symbol. The assigned reel strip for a given array element may be a reel strip assigned by default, or an alternative reel strip chosen based on one or more random elements.

In one embodiment, a reel strip may include a set of graphical symbols having a predetermined probabilistic weight for a game-outcome selection of each graphical symbol on the reel strip. This may include a mapping of a range of random elements (e.g., numbers) to a particular reel stop value of the reel strip, or the inclusion of a series of identical symbols (either actually or logically) on the reel strip. The specific reel strip used for a particular array element may be the same, or different from, a reel strip used for other array elements. The reel strip for a given array element of the symbol array 499 is ultimately used to define a set of game-outcome symbols and probability for each game-outcome symbol for the array element, using random selection based on one or more random numbers generated by an RNG.

It is possible for all the array elements of the symbol array 499 to use a common reel strip, and it is also possible for each array element of the symbol array 499 to use different, unique reel strips. In one embodiment, a combination of these two paradigms is used, where some array elements may have independent reel strips different from all (or most) other array elements of the symbol array, while other array element outcomes may utilize a common reel strip for randomly determining a game-outcome symbol.

Further, a specific array element may have a set of different corresponding reel strips eligible for selection, wherein when the wagering game is initiated a single reel strip is selected for the array element based on one or more random elements. That is, the selection of a specific default reel strip from a plurality of reel strips for the array element may itself be a random decision. Each array element of the symbol array 499 will have a corresponding reel strip selected for visual display and game-outcome symbol generation. In practice, any criteria may be used to select a particular reel strip used by a given array element to generate a corresponding game-outcome symbol. In one embodiment, a reel strip is assigned based on the location of the array element in the symbol array 499.

Additionally, sets of array elements may be collectively grouped together into a linked group, where each array element of the linked group operates to spin (virtually rotate) in coordination with the other array elements of the linked group. That is, there may be a coordinated display of each of the array elements of the linked group even though the linked group array elements are individually identifiable and scattered throughout the symbol array 499. Coordinated animation among plural array elements of a linked group may involve displaying the linked array elements spinning as a single (or having a common) reel, presenting the reels of the linked array elements spinning in unison, staggering a unified animation display of the linked array elements, etc.

A default or alternate reel strip for use on a reel associated with a particular array element of the symbol array 499 may be determined in response to an initial random element generation, or an additional random element generation made during the wagering game. There is a great deal of flexibility available for selecting and assigning a reel strip for a given array element, dependent upon and using a wide variety of options. For example, a specific reel strip used for a linked group of array elements or a stand-alone array element may be statically defined, dynamically generated/assembled, or a combination.

In one embodiment, corresponding reel strips for the array elements of the symbol array may be determined based on whether the array element is performing as a stand-alone reel (having no linked array elements, not part of a linked group), is part of a linked group consisting of only two linked array elements, or is a part of a linked group containing more than two linked array elements.

In one embodiment, two distinct reel strips are defined for a given array element. For example, a default reel strip is assigned to the array element when the array element is not part of a linked group (i.e., there are no corresponding linked reels specified), and a common reel strip is assigned to the array element when the array element is part of a linked group (i.e., other linked reels are specified). The default and common reel strips may be very different in both symbol composition and/or probabilistic weightings for each symbol thereon. For example, an assigned common reel strip may be a slightly modified version of one or more of the default reel strips for the array elements of the linked group. Alternatively, the assigned common reel strip may be identical to a default reel strip of one of the array elements of the linked group. Further, the common reel strip may be a combination of all the default reel strips of the linked group, or alternatively, have no shared symbols with any default reel strip of any of the array elements, whether part of the linked group or not. Indeed, an assigned common reel strip may also include one or more additional or replacement symbols which are not available on any default reel strip specified for any of the array elements of the linked group. Added symbols may include special symbols, bonus or progressive jackpot triggering symbols, variable or changing symbols, WILD symbols, special effect symbols, etc. For instance, added symbols may include any other type of "bonus" symbol(s) that are specifically required to trigger bonus games or jackpot awards of the wagering game.

Additionally, each graphical symbol specified on a reel strip may be probabilistically weighted for random selection as a game-outcome symbol. Reel strips involving weights for each symbol provide a way to assign different probabilities for the various graphical symbols defined therein, even when two reel strips share the same set of potential game-outcome symbols.

As stated prior, the reel strips may be configured with specific reel stop values that correspond to the stopping positions for each symbol of the reel strip. The reel stop values specify the symbol(s) displayed by the corresponding array element when the reel stops spinning. The probabilistic weighting of symbols on the particular reel strips may be achieved by manipulation of the reel strip itself by adding and/or removing symbols from the reel strip to alter the probability of symbol selection, or by mapping a set of values to particular reel stop values specified for the specific reel for comparison against one or more randomly generated numbers. Both methods of weighting are compatible with various embodiments of the current invention. Using many sequential symbols on a reel strip provides an enhanced result of allowing a given array element of the symbol array 499 to display a series of identical symbols while spinning. When plural array elements display series of the same symbols simultaneously in a coordinated display during a wagering game, a player experiences enhanced anticipation and increased entertainment value.

Referring now to FIG. 5, an image of an exemplary portion of a basic-game screen 500 of a wagering game is shown. The game screen 500 contains a five-by-five graphical symbol game-outcome array 599, similar to symbol array 499 described in FIG. 4. The symbol array 599 comprises rows of array elements 501, 502, 503, 504, 505, and columns of array elements 510, 520, 530, 540, 550. Each row 501-505 and column 510, 520, 530, 540, 550 of the symbol array 599 contains a set of respective array elements (e.g., row 503 contains array elements 513, 523, 533, 543, and 553, and column 530 contains array elements 531-535).

During a wagering game, it is possible that the symbol array 599 may have a set of linked groups of array elements that operate collectively in a unified manner. As mentioned prior, array element members of a linked group may display identical symbols while the reels are spinning, and/or derive a unified final game-outcome symbol (from random selection) using a common reel and common reel strip. The outcome symbol may alternatively be derived directly from a game-outcome symbol element displayed by another array element of the linked group.

The wagering game may also randomly determine whether linked groups will occur, the number of linked groups, and the location and number of array elements involved in each linked group of the symbol array 599. In one embodiment, each array element of symbol array 599 is designated as either a stand-alone array element (using a corresponding default reel strip) or a member of a linked group (using a common reel strip for the linked group). The default reel strips for the symbol array 599 may be statically defined or may include dynamically generated symbol combinations. In one embodiment, each array element of the symbol array 599 is assigned a default reel strip used in a wagering game having no specified linked groups. However, when one or more linked groups are statically specified or randomly determined, the default reel strip(s) for one or more of the array elements in a linked group may be replaced with a common reel strip to provide a suitable unification of the array elements during spinning and during display of a common game-outcome symbol.

Linked-group array-element relationships may be independently defined for each instance of a wagering game. Alternatively, a wagering game may statically define linked groups of array elements for each instance of the wagering game. Further, one or more linked groups may be specified in response to a result of a random element generation as part of the base wagering game, and/or as a component of another randomly determined event, such as a bonus game.

In one embodiment, a reel-dependency table is defined that provides all the potential linked group and reel strip combinations possible in the wagering game. The reel-dependency table may designate various combinations of array elements as stand-alone reels using a default assigned reel strip and designate specific array elements as part of (or a randomly generated leader of) a linked group. The reel-dependency table may also specify a set of corresponding symbol array elements as a linked group. The reel-dependency table may also specify the default reels and common reels for any specified array elements, including array elements that are part of a linked group.

Alternatively, the reel-dependency table may make one or several determinations for all the array elements of the symbol array 599 and collectively report a single result. The reel-dependency table may include one or more statically defined tables (including, for example, look up tables or relational databases) having entries corresponding to specific random events, conditions, resulting pattern configurations of linked array elements, reel assignments, etc., based on one or more random elements. Patterns of linked array elements may be specified as a static set of array elements in a specific pattern of the symbol array 599, a patterned set of array elements in the symbol array 599 (optionally located at a random location of the symbol array 599), or a set number of array elements in one of a collection of predefined patterns within the symbol array 599. Typically, linked array elements, in a specific pattern or not, are logically and visually linked together during presentation and gameplay. The reel-dependency table may specify one or more linked array element groups, corresponding reel strips for linked and non-linked array elements, spin profiles, etc.

Alternatively, the reel-dependency table may include a logically defined algorithm using one or more random elements to define the array elements of the symbol array 599 that are part of a linked group, leader of a linked group, part of a linked group having a corresponding leader, completely stand-alone, etc. The reel-dependency table also specifies associated reel strips, either default and/or common, for the array elements of the symbol array 599. Depending on the logic, entries, and specific structure of the reel-dependency table, the number of linked groups and associated symbol elements provided on the reel strip(s) for the array elements of each linked group is variable.

The reel-dependency table may also specifically designate reel strips for particular array elements of the symbol array 599 of the wagering game. For example, in one embodiment, the particular reel strip used for a specific array element of the symbol array 599 is dependent upon whether the array element is a stand-alone reel (i.e., not in a linked group), a linked group leader of a linked group (i.e., an array element having an outcome copied to other array elements), or a linked member of a linked group (i.e., outputting a symbol generated by the outcome of another reel). In one embodiment, a set of default corresponding reel strips are defined for the array elements of the symbol array 599, and an alternative common reel strip is designated for linked group elements for collectively determining a game-symbol outcome elements of a linked group. In some cases, array elements that are part of a linked group utilize identical reel strips to coordinate, unify, and simultaneously display symbols while reels are spinning and during the wagering game-outcome reveal. In one embodiment, the reels for the array element members of a linked group are assigned a common reel strip duplicated from a designated leader of the linked group. In other embodiments, a common reel strip is generated or chosen and shared among the array elements of a linked group based upon a random determination, the linked group size, and/or specific array element locations. The use of common (and/or duplicated reels/reel strips) is particularly useful when coordinating presentation of the array elements of the symbol array 599 that include synchronizing multiple reels spinning in unison, simultaneously, collectively, cascading, etc.

In one embodiment, the wagering game is initiated and the reel-dependency table is consulted by the game-logic circuitry during the wagering game to determine the linked groups for the wagering game. For example, in the embodiment shown in FIG. 5, the reel-dependency table is consulted and designates a linked group of array elements containing all the array elements of the row 510 and the row 530. The presentation of this linked group may include simultaneously displaying the spinning reel strips of array elements 511-515 and 531-535 in unison and stopping in a unified manner at the same game-outcome symbol, in this case, "7-JACKPOT." Other forms of presentation are also possible, including cascading (or otherwise coordinating) the display of the spinning and stopping of the individual array element reels, eventually revealing the same game-outcome symbol for all the linked-group array elements of the symbol array 599.

In another embodiment, the reel-dependency table dictates a linked group comprising all the array elements in the row 510 and the row 530, having array element 511 as the linked group leader. In this case, the game-outcome symbol of the array element 511 is determined independent from other array elements, and the symbol outcome of array elements 512-515 and 531-535 are linked to (i.e., dependent upon) the game-outcome symbol of the array element 511. The presentation of this linked group may include a unified visual indication as described above, or alternatively, an indication at array elements 512-515 and 531-535 that the game-outcome symbol for these array elements result from the determination made for the array element 511. For example, the spinning reel of array element 511 may be highlighted during rotation and the game-outcome symbol of the array element 511 is copied to the array elements 512-515 and 531-535 when array element 511 stops spinning. Alternatively, there may be no discernable difference from the player perspective that anything is different than the array elements of the linked group using the same reel.

The reel-dependency table may also designate a specific set of reels and corresponding reel strips used to randomly determine the game-outcome symbol for each independent and linked group array element in the symbol array 599. This may include a predetermined definition (and assignment) of default reels used when an array element has no associated linked group, and a specification or logic for reel generation/assignment for linked group array elements.

However, if a linked group is determined, an alternative or common reel may be designated for the array elements of the linked group. For example, the reel-dependency table may selectively designate a particular reel to be used by array element 511, specifically as a result of being part of the defined linked group, including linked-group leader status and dependency relationships of the array elements 512-515 and 531-535. As detailed prior, the selection of a specific reel may be for an array element may be based on a number of elements in a linked group, the position of the linked group elements in the symbol array 599, and/or the result of an initial or additional random element. The game-outcome symbol result of a linked-group leader array element is duplicated to other array elements. Alternatively, the elements of the linked group may collectively use a common reel to determine the game-outcome symbol.

In this embodiment, the reel-dependency table determines the game-outcome symbol rules (i.e., the reels and corresponding reel strips utilized) for each of the array elements of the symbol array 599. This includes the stand-alone reels using default reels in the array elements present in rows 520, 540, 550. Additionally, an alternative common reel for the array element 511 is determined that is different from a default reel used when the array element 511 were not part of the linked group. Alternatively, a common reel may be designated for each of the linked array element reels 512-515 and 531-535 to synchronize display of the spinning reels during the wagering game, as opposed to presentation displaying duplication of the game-outcome symbol determination for the array element 511.

In response to defining the relationships and reels for all the independent and linked group reels as determined by the reel-dependency table, the wagering game determines the entirety of the wagering game outcome and visually displays a presentation process that includes virtually spinning the reels for the array elements of the symbol array 599. In one embodiment, the determination may include generation of a set of further random elements (and determining corresponding reel stops indicating a particular game-outcome symbol) for each of the independent, stand-alone array elements. In another embodiment, the wagering game outcome is an extension of the generated random element(s) used for consultation of the reel-dependency table and the corresponding lookup results. Regardless of the specific methodology employed, a game-outcome symbol determination occurs for each array element of the symbol array 599, collectively resulting in a corresponding wagering game outcome. The game-outcome symbol determined for each array element of the symbol array 599 is a result of a random game-outcome symbol determination from the corresponding reel for that particular array element.

In one embodiment, a game-outcome symbol is determined for each independent, stand-alone array element (in accordance with the designated and corresponding reel and reel strip and one or more random elements). The game-outcome symbol for all linked group array elements of the symbol array 599 are derived from the corresponding linked group leader symbol outcome, as dictated by the reel-dependency table. For example, the game-outcome symbol for the array elements 512-515 and all the array elements in row 530 (531-535) may be determined from the game-outcome symbol of the link group leader array element 511. After the game-outcome symbol for array element 511 is determined, the game-outcome symbol for array elements 512-515 and 531-535 are suitably determined. This may further include the intermediate determination of reel stop positions for each of the reels of the array elements of the linked group. Using corresponding reel stop positions for each of the array elements of the linked group enables coordination of display of game-outcome symbols that are identical, even when differing reel strips are used for differing array elements.

In one embodiment, visually coordinated or synchronized spinning array elements may use "spin profiles" to provide presentation and visual templates to simplify processing. Spin profiles may enable various types of array element display coordination during the wagering game. In a simple example, a corresponding spin profile may be selected for each independent reel of the wagering game, each spin profile providing the details (e.g., direction, acceleration, top speed, duration, deceleration, etc.) for the visual presentation of a plurality of independent reels. In other embodiments, a spin profile may be selected particularly for sets of independent reels to provide coordinated display. A large variety of spin profiles may be defined and be available for selection, prior to display of the array elements and the symbol array 599 as a whole, to coordinate visualization during and at conclusion of the wagering game. For example, a particular spin profile may be chosen for a set of linked array elements presented in the symbol array 599, such as the array elements in rows 510 and 530. The spin profile encompasses the presentation operation of all the reels of the linked group, or may alternatively use separate, respective spin profiles for the array elements in row 510 and row 530 even though the two groups are linked. When all the array elements of rows 510 and 530 utilize the same reel to determine a game-outcome symbol, the same spin profile may be selected for the rows 510 and 530 as a whole.

One example of a spin profile may dictate that at the beginning of the wagering game, the linked reels appear to operate independently, but slowly converge to a visualized spinning using a unified reel. In addition to dictating how the array elements are displayed while spinning, a spin profile may also include other presentation parameters, such as a darkened border around the linked group of array elements and even accompanying audio segments to be rendered during the reel spinning and overall wagering game presentation process. Further, a spin profile may dictate how one or more array elements are visually displayed when spinning, particularly in response to one or more array elements stopping at a particular game-outcome symbol. For example, a spin profile may dictate that the appearance of two or more special "bonus" symbols (as game-outcome symbols) may cause an increase in the time of spinning for some or all of the remaining array elements to enhance player anticipation and excitement awaiting for a third (or additional) winning bonus symbol.

The spin profiles may include motion parameters for an array element that may be used to control, manage, or establish motion of individual array element reel(s) of a linked group or the linked group as a whole. The motion parameters may include velocity or acceleration values for one or more array element reels at given times during a spinning presentation. This may involve using a set of motion parameters correlated to a start time and a finish time, or the use of a set of time periods for motion and display. The motion parameters may include a velocity at the start of a time period and a velocity at the finish of the time period along with a perceived acceleration for one or more of the linked group array element reels during the start or finish. The spin profiles may also dictate the coordination of the motion of each array element of the linked group, for example, for providing parallel cascading presentations for the array elements of a linked group. A spin profile may also dictate the display of the spinning of a single array element reel being copied to a place holder other linked group array elements. Ultimately, the spin profile chosen to coordinate display of the array elements of a linked group defines a unified presentation methodology for each of the array elements of the linked group. In cases where there are multiple linked groups, multiple spin profiles may be used together (or independently) to create a presentation for each of the linked groups according to the corresponding spin profile.

The granularity of a spin profile may include only a specific array element, a set of array elements (e.g., linked together as a group), or the entire symbol array 599 as a whole. More than one spin profile may be used collectively to construct a unified presentation of the wagering game in a modular fashion. For example, the selection of one or more spin profiles for one or more array elements may be combined with other spin profiles for other array elements, linked groups, or areas of the symbol array 599. In operation, one or more selected spin profiles will ultimately determine how the array elements will be displayed. The spin profiles will control the display of array elements as the wagering game is initiated and begins (e.g., indicating linked groups), during the spinning and resolving of the wagering game (e.g., indicating linked groups, array element rotation speed and duration, coordinated presentation, alterations of visuals of the reel strips, etc.), and as the wagering game concludes and renders the game-outcome symbols (e.g., the stopping of the reels, changing of reel symbols when stopped, copying symbols, etc.).

It is noted that a visual indication of the linked group(s) to the player may or may not occur, even while implementing spin profiles to define presentations. In fact, even after the wagering game symbol output is revealed, it may not be obvious to a player which array elements of the wagering game are members of a linked group, nor the reel strip employed for any given array element. One example includes all the array elements of the symbol array 599 appearing to use a common reel (or show a spinning sequence of identical symbols).

To display a wagering game outcome, a game-outcome symbol for the array elements of the symbol array 599 must be determined. A graphical presentation of the game-outcome symbols of the array elements of the symbol array 599 is displayed to the player via the graphical interface. Graphical presentations may occur instantaneously, take several seconds, or be prolonged as long as desired by the designer, in a variety of methods. The use of spin profiles as outlined prior is an easy way to implement a particular type of presentation behavior. In one embodiment, each of the array elements visually displays a spinning reel using a selected, corresponding spin profile. The presentation of the spinning reel for each array element may include independent use of a common reel assigned to multiple array elements of a linked group, or may implement differing reels among members of a linked group. Alternatively, the game-outcome symbol for the array element members of a linked group may be copied from a game-outcome symbol determination made for a single linked group leader. Regardless of whether common reels, differing reels, or no reels are employed to determine the game-outcome symbol for one or more of the elements of a linked group, the game-outcome symbol displayed for the members of the linked group will be identical. Thus, the selection of spin profiles for the array elements of the linked group as a whole, or for independent array elements of a linked group may be collectively utilized to properly coordinate and/or synchronize the display of the symbol array as a whole during presentation of the wagering game.

Graphical game-outcome symbol presentation may also include a coordinated or synchronized display of all array elements of a linked group (as a whole), including any and all linked graphical array elements using spin profiles. Presentation may include display of all linked group elements, separately or in combination with, the display of the spinning reel of a linked group leader. For example, the reel designated for the array element 511 may be used to generate a coordinated visual sequential presentation for the entire linked group that includes a coordinated display of symbols for each array element in rows 510 and 530. Alternatively, each array element in rows 510 and 530 may independently generate an identical symbol outcome by independently spinning one or more reels and stopping at the same symbol. This may be achieved using reel stops corresponding to the same game-outcome symbol as discussed prior.

In FIG. 5, it is noted that the array element 544 also displays the same symbol as the array elements common to all array elements of the rows 510 and 530. In one embodiment, the array element 544 may not be part of a linked group (i.e., independent from the outcome of all other reels) and is determined in complete isolation from the outcome of the linked group of the array elements of the rows 510 and 530. In another embodiment, the reel-dependency table may dictate all array elements in the rows 510 and 530 be linked to the symbol outcome of another array element, for example, array element 544, which would result in an identical graphical output as shown in FIG. 5.

In one embodiment, a reel-dependency table providing the linked group relationships for array elements for each execution/spin of the wagering game is designed to provide a great deal of flexibility in the number, location, and constraints for array elements of the symbol array 599 when generating the game-outcome symbols. The designations of the array elements as independent stand-alone, linked group members, linked group leaders, etc., are completely arbitrary, and are generally based on one or more generated random elements. Further, the positions of array elements of a linked group are not necessarily fixed or static. In one embodiment, the reel-dependency table may specify linked group array elements to be adjacent to a corresponding linked group leader or a specific array position (or not), all in the same row or differing rows, in the same column or differing columns, conforming to a specified pattern, or randomly generated using logic specified by the reel-dependency table (for example by algorithm or software module). Also, the specific reels relied upon for determination of the game-outcome symbol for each and every array element of the symbol array 599 may be designated and determined by an algorithm. For example, using a reel-dependency table having a single lookup, or dynamically using one or more random elements to determine the independent reels, the linked groups, and all corresponding reel strips for the array elements, are all within the spirit and scope of the invention.

Figure 6:
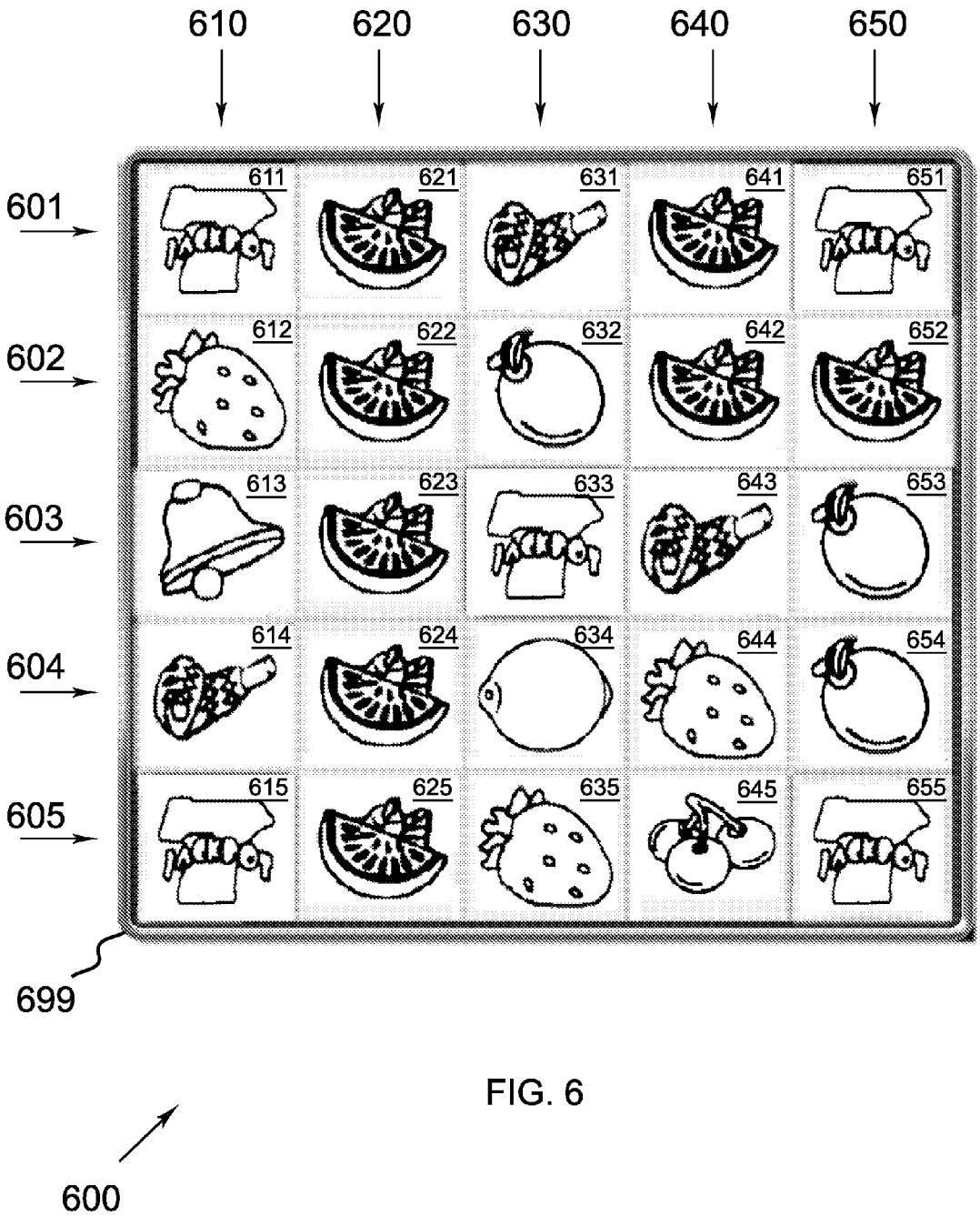
FIG. 6 is an image of an exemplary basic-game screen of a wagering game displayed on a gaming machine having multiple linked groups, each comprising a plurality of symbol array elements which conform to the same game-outcome symbol, according to an embodiment of the present invention.

Referring now to FIG. 6, an image of an exemplary portion of a basic-game screen 600 of a wagering game displayed on a gaming machine is shown. The game screen 600 contains a five-by-five symbol array 699, similar to symbol array 499 and 599 described in FIG. 4 and FIG. 5, respectively. The symbol array 699 comprises rows of graphical array elements 601, 602, 603, 604, 605, and columns of graphical array elements 610, 620, 630, 640, 650. Each row and column of the graphical array elements contains a set of respective graphical array elements (e.g., row 603 contains graphical array elements 613, 623, 633, 643, 653 and column 630 contains graphical array elements 631-635).

Prior to initiation of the wagering game, a default reel strip may be assigned to a reel for each array element of symbol array 699. Alternatively, a set of default reel strips may be defined for assignment to reels for the array elements of the symbol array 699 that are not designated as part of a linked group. Thus, if no linked groups are determined by the random element(s) generated by the wagering game upon initiation, each of the array elements of the symbol array 699 will have an assigned, default reel strip to use to determine a corresponding game-outcome symbol for the wagering game using the respective default reel. However, in this embodiment the game is initiated and a reel-dependency table is consulted, determining there will be multiple linked groups of array elements using specific reels in this instance of the wagering game.

FIG. 6 specifically displays multiple instances of linked groups (i.e., plural combinations of linked group array elements) simultaneously in the same symbol array 699. In this example, random elements use a reel-dependency table to define two distinct linked groups occurring when the wagering game is performed. A visual indication of the linked group(s) to the player may or may not occur; in fact, even after the wagering game outcome is revealed, it may not be obvious to a player which array elements of the symbol array 699 are members of a linked group, nor the specifics of the reel employed for any given array element.

In this example, by using random elements, the reel-dependency table dictates the wagering game uses a first linked group including a linked group leader array element 621 having linked array elements 622-625. Thus, all the outcome symbols for the array elements of column 620 will conform to the output symbol determined for array element 621. The random elements also designates that a reel using a specific reel strip will be used for the game-outcome symbol generation for array element 621, and the reel presentation for array element 621 will be copied to array elements 622-625. In this case, the designated reel for array element 621 is different from the default reel initially assigned to array element 621 used when no linked groups are defined. Further, the reel is specified by the reel-dependency table (based on one or more of the random elements generated at game initiation) to be chosen from a set of the default reels of the array elements of the linked group, column 620. The reel chosen to generate the output symbol for array element 621 may be randomly selected or statically assigned. The reel may be the default reel for array element 621, a predefined reel having a reel strip generated from the symbols on all the default reels of the linked group (optionally having predefined probabilistically weighted symbols), a dynamically generated reel using a predetermined set of symbols, and may even include symbols that are not on any default reels or reel strips of the linked group element reels, etc.

In one embodiment, a reel-dependency table may also designate, specify, or determine a second linked group of array elements. As shown in FIG. 6, a second group of linked array elements include the center array element 633, in combination with the four array elements located at the corners of the symbol array 699 (i.e., array elements 611, 615, 651, 655). The second linked group array elements are designated to derive a game-outcome symbol from the game-outcome symbol of array element 633. Thus, in this case, the reel-dependency table dictates that the array element 633 will be the linked group leader, and ultimately determine the game-outcome symbol displayed for linked array elements 611, 615, 651, 655. As above, random elements and the reel-dependency table designate the reel used for game-outcome symbol generation for array element 633, and may result in duplicate reels or reel strips for the other array elements 611, 615, 651, 655 of the linked group during the wagering game.

Optionally, the random elements may cause the reel-dependency table to dynamically define or replace the reels or reel strips for every array element of one or more linked groups in response to the designation and declaration of these linked groups. For example, the reel-dependency table may designate a new set of default reels for particular independent stand-alone reel array elements. This may occur for particular array elements of the symbol array 699, for example, all independent stand-alone array elements having no associated dependencies. Likewise, a first alternative common reel may be specified for a linked group or linked group leader in response to a specific condition being met (such as a particular linked array element located in a specific position of the symbol array 699). The reel-dependency table may also specify a defined second (or even third) alternative common reel, for example, when one to three additional linked array elements are present in the linked group or four or more additional linked array elements present in the linked group.

When a wager is placed, the following process is performed in one embodiment of the invention. In response to receiving an input indicative of the wager, an initiation of the wagering game occurs. In response to the wagering game initiation, one or more random elements are generated to determine the outcome of the wagering game. Based upon the one or more random elements, the reel-dependency table is consulted, the linked groups are defined and determined, reels with corresponding reel strips are determined accordingly (having associated reel stop values for particular symbols on the reel strip), and the resulting game-outcome symbols are determined (in accordance with the appropriate reel strips for each array element and the corresponding reel stop values). A visual presentation leading up to display of the wagering game outcome is performed, generally displaying the spinning of the reels assigned to each of the array elements. When the reels stop spinning, a wagering game outcome is generated having graphical game-outcome symbols displayed in the array elements of the symbol array 699.

It is noted that the wagering game outcome shown in FIG. 6 displays array elements 641, 642, 652, sharing the same game-outcome symbol as the array elements of row 620. While it may appear to be an additional effect or result of the use of a reel-dependency table (either being linked to another array element or in yet another grouping), in the present example, the independent stand-alone reel array elements 641, 642, 652, are not part of any defined linked group of array elements. Graphical presentations that synchronize or coordinate the game-outcome symbol display for any linked groups, for example by using spin profiles, is one way to inform a player about symbol elements that are part of linked groups, and those that are not. As mentioned prior, the indication of linked groups of array elements, designation of linked array elements, and reel composition for one, many, or any of the array elements of the symbol array 699 is totally discretionary. However, among linked group elements, graphical presentation may be coordinated or synchronized with one another to enhance presentation; further distinction of linked and non-linked array elements may be made, for example, using a distinct lack of synchronized presentation for array elements that are independent or unrelated to members of one or more linked groups. Any or all of these presentation effects and coordinated process may be achieved using the above described spin profiles or a variety of other methods omitted for brevity.

After the wagering game outcome is displayed, a visual association of the symbol array 699 is actively compared to a set of defined patterns and paylines in a pay table to determine a corresponding pay out. That is, the wagering game performs an evaluation of the displayed array of game-outcome symbols on the stopped reels of the array elements and provides awards and bonus features in accordance with the pay table to the player. This may include "line pays" when a predetermined type and number of symbols appear along an activated payline, and "scatter pays" when a predetermined type and number of symbols appear anywhere in the displayed array without regard to position or paylines. Other combinations of symbols may trigger bonus rounds, additional bonus rewards or benefits, free spins, free wagering game plays, etc. The wagering game may also provide mystery awards and features independent of the symbols appearing in the displayed array. Any of these bonus features may additionally consult the reel-dependency table, using the same or modified methodologies for providing dependency relationships, linked groups, reel definitions, etc., between array elements, corresponding reels, etc. as detailed prior.

Figure 7:
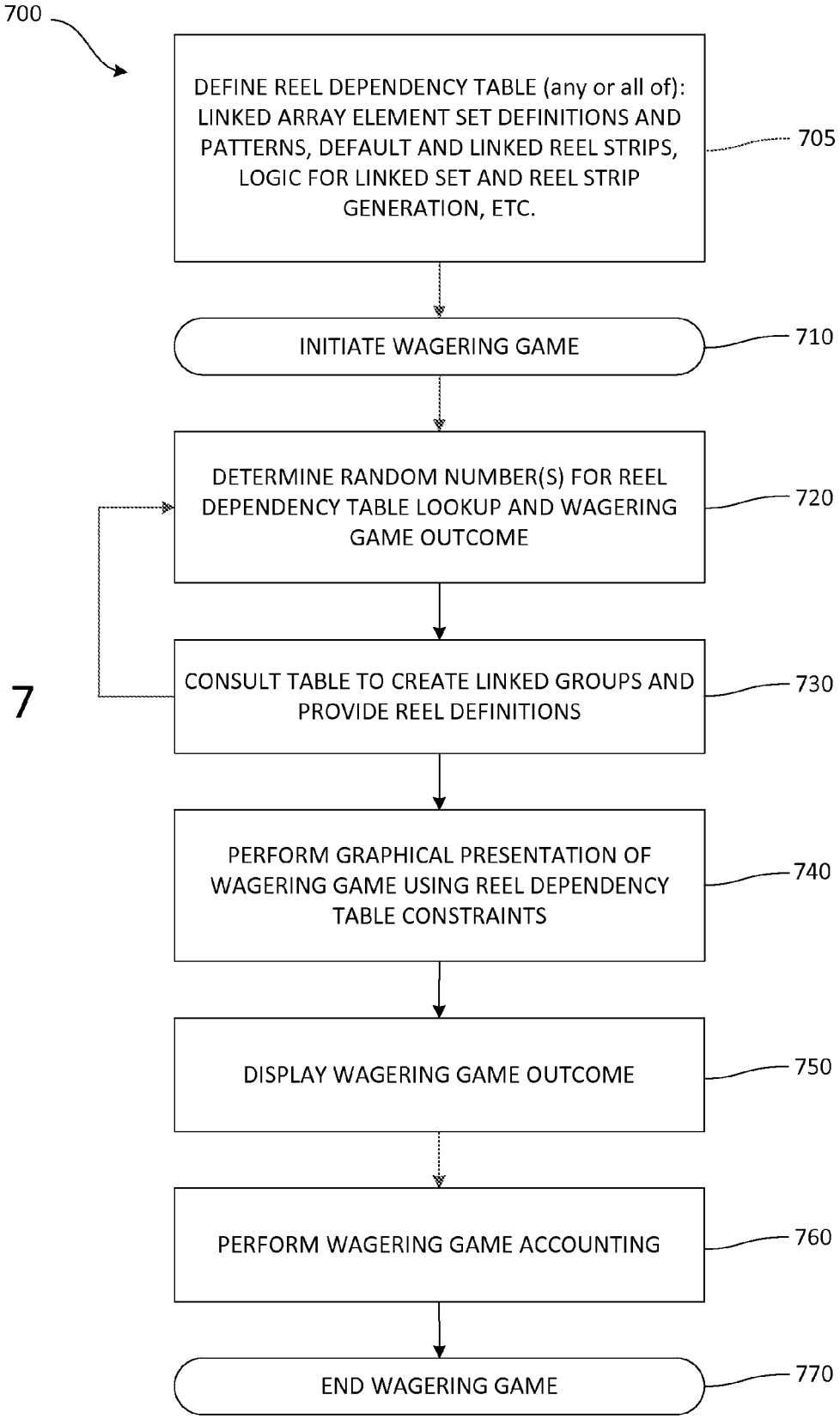
FIG. 7 is a flowchart for an algorithm that corresponds to instructions executed by a controller in accord with at least some aspects of the disclosed concepts.

Referring to FIG. 7, a process 700 for performing the wagering game in one embodiment is shown. Wagering game execution process 700 starts when the wagering game is initialized in step 705. The reel-dependency table is defined and stored in memory. As detailed prior, the reel-dependency table may store the specifics of the type of linked groups that may be formed, the reels associated with the array elements during the wagering game, entries which may specify linked array element set definitions (potentially including ranges or values of random numbers to dictate results), predetermined patterns for linked groups, reel strip definitions including default reels and other reel strip definitions used when one or more conditions for linked group array elements are satisfied, logic for statically or dynamically determining linked groups based on one or more random numbers, logic for statically or dynamically generating or determining the reel strips used by the independent and/or linked groups, etc. This example of the contents and use of the reel-dependency table is not meant to be all inclusive or all encompassing; the reel-dependency table may be highly variable and provide a wide variety of information and processes that enable a game designer to implement the invention as described.

In step 710, the wagering game is initiated. In one embodiment, game initiation occurs as a result of reception and commitment of a wager, for example a player hitting the SPIN REELS button.

In step 720, a set of random elements are determined for the wagering game. In some embodiments, the random elements are random numbers in a specific range. The number and type of random numbers that are generated may vary from game to game and may be directly related to the format of the reel-dependency table. Alternatively, the format of the reel-dependency table may dictate the number or type of random elements that must be generated for a particular wagering game instance. In one embodiment, the one or more random elements will be used in conjunction with the reel-dependency table to determine the potential and use of linked groups, corresponding reel strip usage for each array element, possible game outcomes, etc. In one embodiment, a random element is generated that causes the reel-dependency table to specify a default set of reels having corresponding reel strips used by all array elements of the symbol array of the wagering game to generate a wagering game outcome. In other embodiments, random elements may be generated for each independent stand-alone reel of the wagering game. In other embodiments, one or more random elements may be generated and used to specify the number and type of linked groups, including which elements comprise each linked group.

In step 730, based on the random elements, the reel-dependency table is consulted to determine and declare the operational constraints of the game-outcome symbol array, including the specifics of the number and type of linked groups, independent stand-alone array elements, and corresponding reels and reel strips for each array element of the wagering game. The reel-dependency table may be structured to dictate that one or more random numbers within a specific range cause linked groups and array element relationships to be immediately established, or be otherwise determined using additional random element generation. The reel-dependency table also defines the reels for the array elements by determining the resulting reel strip definitions and assignments for independent array elements and any linked groups.

As detailed prior, the reel-dependency table may declare, based at least in part on the one or more random elements, that one (or multiple) array elements are part of a defined linked group, along with corresponding reels and respective reel strips. The reel-dependency table may also specify a role for each array element specified in the linked group. For example, a linked group leader may be specified for a particular linked group for the wagering game, along with a specific reel strip definition used for symbol outcome determination for the linked group.

The reel-dependency table may be consulted a number of different times, and may be used to create any number of sets of linked groups, each including linked group elements having reels sharing identical reel strips, as well as game-outcome symbol of a single independent stand-alone reel of the wagering game. As the reel-dependency table requires more random elements, flow may temporarily return to step 720 before resolving the state of the wagering game using the reel-dependency table.

In one embodiment, the reel-dependency table assigns a default reel strip to the reel for each array element, determines any linked group sets of array elements, replaces the default reel strips of the reels of linked group array elements, and determines the game-outcome symbol for all the array elements of the wagering game based on the one or more random elements.

In step 740, once the game-outcome symbol for the array elements are established, a presentation process of the wagering game is performed. The presentation and display of the wagering game for the player is meant to be engaging and entertaining, in addition to intuitively informing the player about some of the random determinations made that will forge the eventually displayed wagering game outcome. Visual indication of the results of the random element generation and consequential events may not be reflected or detailed to an observing player. Thus, it may not be obvious to a player which array elements of the symbol array are members of a linked group. Further, the composition of the symbol on a reel or a component reel strip for a particular symbol array element may not be immediately evident to the player.

In one embodiment, the wagering game presentation includes coordinated and/or synchronized graphical (and accompanying audio) presentation of the entirety of the symbol array for the wagering game. Different portions of the symbol array may be selectively, separately, or uniformly coordinated. For example, each element of the symbol array may be displayed as completely independent when no linked groups are defined or independent synchronization or coordination of linked group array elements may occur when such linked groups are dictated by the reel-dependency table.

The coordinated presentation of linked groups may include a variety of visual effects. Presentation may include a cascading display of the spinning reels of the linked group in a uniform fashion, a highlighting of the linked group as the reels are spinning, a staggered or uniform rotation of the spinning reel strips for the elements of the linked group, or none of the above. Additionally, when using a linked group leader, spinning the reel having the reel strip of the group leader array element may occur in combination with other linked array elements. For example, displaying blank or animated references to the group leader by location or animation, or displaying a copy of the group leader animation, is possible.

Many presentation methods may employ the use of reel stop position values that indicate a location on a reel for a given outcome symbol. Reel stop position values may be weighted on specific reel strips and reels to alter the probability of the selection of a particular outcome symbol. Reels employing reel strips having long series or occurrences of identical symbols may also define the probability for symbol outcome selection, but must also be equated to reel stop position values to determine which symbols should be shown when the outcome symbols are displayed. Reel stop position values may also be used to define the sequence, size, and/or presented symbols of a given reel strip on a reel. Reel stop position values for a particular reel may be stored as part of the reel-dependency table and used to efficiently determine and display the outcome symbols for each of the array elements of the outcome symbol array.

The use of spin profiles may also be implemented in conjunction with the reel-dependency table, which may reasonably correlate the linked groups, reels, reel strips, and presentation methodology into a single record. In this way, the presentation of the wagering game, including the presentation of each linked group of array elements, may be unified and coordinated into a single logical process using all of these mechanisms. The flexibility of this modular approach to presentation provides a powerful toolkit for a designer to specify the type of presentation for the wagering game as a whole, in addition to individual elements and linked groups, even when faced with displaying the wagering game having many permutations based on random number selection.

Varying forms of presentation and outcome-reveal of the wagering game may provide increased player entertainment and higher player engagement with the wagering game. Effective presentation also informs the player of mechanics of the wagering game without using language or complicated visuals in an intuitive manner. The coordination of array elements for each linked group is suitably generated to reflect the selections and dictations specified by the reel-dependency table while increasing aesthetics of the wagering game.

Additionally, the wagering game may display payline determinations, winning combination visuals, bonus rounds, additional free spins, additional animations or video sequences, etc. The wagering game then concludes the visual and audio presentation of the wagering game, and completes the formal portion of the wagering game from the player perspective.

In step 750, the wagering game outcome is formally displayed, comprising the game-outcome symbol of each of the symbol array elements. This may include a rotating highlighting of symbol combinations of the symbol array that are winning combinations, display of specific text, or a combination, as known in the art. Other forms of presentation that reflect the end of the wagering game may also be employed without departing from the scope and spirit of the invention.

In step 760, accounting is performed for the wagering game. Accounting may include the recording of game state and winnings to one or more non-volatile memories, in accordance with regulation or design choices, potentially due to required jurisdictional regulations. Accounting may also include the transfer of credits to the player credit meter to finalize the wagering transaction.

In step 770, the wagering game concludes, and may return to an end game presentation state and/or an attraction mode of operation enticing the player to initiate the wagering game by making a wager.

The disclosed embodiments detail a wagering machine, system, and method for performing enhanced wagering game mechanics which enable a specialized wagering game machine to create one or more linked groups of symbol outcomes on distinct elements of a symbol array, where all the symbol array elements comprise corresponding game-outcome symbols to generate an outcome to the wagering game. The use of a reel-dependency table may use randomly generated elements to dictate conditionally defined reels, reel strip components, linked group compositions, and spin profiles of array elements and/or linked groups for a wagering game. The wagering game may result in the generation of a graphical outcome symbol bearing array and a corresponding award dependent upon the wagering game outcome.

However, none of the above embodiments as presented and detailed are to be specifically held as limiting. Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A casino gaming machine primarily dedicated to playing at least one regulated casino wagering game including a primary wagering game having a symbol array of individual array elements, each individual array element having a respective reel defined by a corresponding default reel strip, the gaming machine comprising:

a secure gaming cabinet for housing components associated with the at least one casino wagering game;

an electronic display device coupled to the gaming cabinet;

and game-logic circuitry disposed within the gaming cabinet and including a random element generator, the random element generator configured to generate one or more random elements, the game-logic circuitry further configured to:

initiate the primary wagering game in response to a wager from a player;

link, after initiating the primary wagering game, a plurality, but not all, of the individual array elements, the linking based, at least in part, on the one or more random elements;

replace the default reel strips of the linked array elements with a common reel strip selected from a plurality of reel strips;

direct the electronic display device to display the reels of the plurality of array elements of the symbol array actively spinning, the default reel strips of the linked array elements being replaced prior to stopping the active spinning of the reels; and direct the electronic display device to display an outcome of the primary wagering game by stopping the active spinning of the reels of the plurality of array elements at a specific reel stop position of the corresponding reel strip for each array element, each of the plurality of array elements displaying a game outcome symbol based, at least in part, on the one or more random elements, wherein the game-outcome symbols displayed by each of the reels of the linked array elements are the same symbol.

2. The gaming machine of claim 1, wherein the game-logic circuitry is further configured to:

identify a linked group leader from the linked array elements; and replace the default reel strips of the linked array elements with the default reel strip of the linked group leader.

3. The gaming machine of claim 1, wherein the common reel strip contains game-outcome symbols that are not present on any of the default reel strips of the linked array elements.

4. The gaming machine of claim 1, wherein the reels of the plurality of linked array elements are synchronized while spinning.

5. The gaming machine of claim 1, wherein the game-logic circuitry is further configured to use a reel-dependency table to specify the linked array elements.

6. The gaming machine of claim 5, wherein a pattern of the linked array elements of the symbol array is specified in the reel-dependency table as part of a plurality of predefined patterns of linked array elements, and wherein linking the plurality of array elements includes randomly selecting the pattern from the plurality of predefined patterns.

7. The gaming machine of claim 1, herein the game-logic circuitry is further configured to:

link a second plurality of the array elements, the linking based, at least in part, on the one or more random elements;

replace the default reel strips of the linked second plurality of array elements with a second common reel strip selected from a second plurality of reel strips;

direct the electronic display device to display the reels of the plurality of array elements of the symbol array actively spinning, such that the display of the reels of the second plurality of linked array elements are visually coordinated; and direct the electronic display device to display the outcome of the primary wagering game, wherein the game-outcome symbols displayed by each of the reels of the second plurality of linked array elements are the same symbol.

8. A method of operating a gaming system primarily dedicated to playing at least one regulated casino wagering game including a primary wagering game having a symbol array of individual array elements, each individual array element having a respective reel defined by a corresponding default reel strip, the gaming system including a secure gaming cabinet, a random element generator, game-logic circuitry, and an electronic display device coupled to the gaming cabinet, the method comprising:

generating one or more random elements with the random element generator;

receiving a wager input to initiate the primary wagering game;

linking, by the game-logic circuitry, a plurality, but not all, of the individual array elements after initiating the primary wagering-game and prior to displaying an outcome of the primary wagering game, the linking based, at least in part, on the one or more random elements;

replacing, by the game-logic circuitry, the default reel strips of the linked array elements with a common reel strip selected from a plurality of reel strips;

displaying, on the electronic display device, the reels of the plurality of array elements of the symbol array actively spinning, the default reel strips of the linked array elements being replaced prior to stopping the active spinning of the reels:

displaying, on the electronic display device, the outcome of the primary wagering game by stopping the active spinning of the reels of the plurality of array elements of the symbol array at a specific reel stop position of the corresponding reel strip for each array element, each of the plurality of array elements displaying a game-outcome symbol based, at least in part, on the one or more random elements, wherein the game-outcome symbols displayed by each of the linked array elements are the same symbol.

9. The method of claim 8, wherein replacing the default reel strips of the linked array elements with the common reel strip further comprises:

identifying, by the game-logic circuitry, a linked group leader from the linked array elements; and replacing, by the game-logic circuitry, the default reel strips of the associated linked array elements with the default reel strip of the linked group leader.

10. The method of claim 8, wherein the common reel strip contains game-outcome symbols that are not present on any of the default reel strip of the linked array elements.

11. The method of claim 8, wherein the reels of the plurality of linked array elements are synchronized while spinning.

12. The method of claim 8, further comprising using, by the game-logic circuitry, a reel-dependency table to specify the linked array elements.

13. The method of claim 12, wherein a pattern of the linked array elements of the symbol array is specified in the reel-dependency table as part of a plurality of predefined patterns of linked array elements, and wherein linking the plurality of array elements includes randomly selecting the pattern from the plurality of predefined patterns.

14. The method of claim 8, further comprising:

linking, by the game-logic circuitry, a second plurality of the array elements, the linking based, at least in part, on the one or more random elements;

replacing, by the game-logic circuitry, the default reel strips of the linked second plurality of array elements with a second common reel strip selected from a second plurality of reel strips;

displaying, on the electronic display device, the reels of the plurality of array elements of the symbol array actively spinning, such that the display of the reels of the second plurality of linked array elements are visually coordinated; and displaying, on the electronic display device, the outcome of the primary wagering game, wherein the game-outcome symbols displayed by each of the reels of the second plurality of linked array elements are the same symbol.

15. A gaming system primarily dedicated to playing at least one regulated casino wagering game including a primary wagering game having a symbol array of individual array elements, each individual array element having a respective reel defined by a corresponding default reel strip, the gaming system comprising:

a secure gaming cabinet for housing components associated with the at least one regulated casino wagering game;

an electronic display device coupled to the gaming cabinet;

a random element generator configured to generate one or more random elements; and game-logic circuitry configured to:

initiate the primary wagering game in response to a wager from a player;

link, by the game-logic circuitry, a plurality; but not all, of the individual array elements after initiating the primary wagering game, the linking based, at least in part, on the one or more random elements;

replace the default reel strips of the linked array elements with a common reel strip selected from a plurality of reel strips;

direct he electronic display device to display the reels of the plurality of array elements of the symbol array actively spinning, the default reel strips of the linked array elements being replaced prior to stopping the active spinning of the reels: and direct the electronic display device to display an outcome of the primary wagering game by stopping the active spinning of the reels of the plurality of array elements of the symbol array at a specific reel stop position of the corresponding reel strip for each array element, each of the plurality of array elements displaying a game-outcome symbol based, at least in part; on the one or more random elements, wherein the game-outcome symbols displayed by each of the reels of the linked array elements are the same symbol.

16. The gaming system of claim 15, wherein the random element generator and the game-logic circuitry reside within the gaming cabinet.

17. The gaming system of claim 15, further including a value input device disposed on the gaming cabinet and used to fund the casino wagering game.

18. The gaming system of claim 15, wherein the reels of the plurality of linked array elements are synchronized while spinning.

19. The gaming system of claim 15, wherein the game-logic circuitry is further configured to use a reel-dependency table to specify the linked array elements.

20. The gaming system of claim 19, wherein a pattern of the linked array elements of the symbol array is specified in the reel-dependency table as part of a plurality of predefined patterns of linked array elements, and wherein linking the plurality of array elements includes randomly selecting the pattern from the plurality of predefined patterns.

* * * * *